United States Patent [19]

Ricciardi

[11] 4,037,634

[45] July 26, 1977

[54] WALLET CONSTRUCTION

[75] Inventor: Franc M. Ricciardi, New York, N.Y.

[73] Assignee: Richton International Corporation, New York, N.Y.

[21] Appl. No.: 696,776

[22] Filed: June 16, 1976

[51] Int. Cl.[2] ..... A45C 1/06

[52] U.S. Cl. ..... 150/36

[58] Field of Search ..... 150/35, 38, 36

[56] References Cited

U.S. PATENT DOCUMENTS

| | | | |
|---|---|---|---|
| 1,787,054 | 12/1930 | Scheuer | 150/38 |
| 2,271,787 | 2/1942 | Wege | 150/36 |
| 2,438,655 | 3/1948 | Becker | 150/36 |

*Primary Examiner*—Donald F. Norton

*Attorney, Agent, or Firm*—Salter & Michaelson

[57] ABSTRACT

A wallet construction comprised of a plurality of panels, including a rear panel and an intermediate panel joined to the rear panel at the ends and along an interior longitudinal edge thereof to define a large pocket therebetween that extends the length of the panels and that is of a dimension for receiving paper currency therein, an interior pocket being located within the large pocket and occupying substantially the same dimension thereof and having a mouth that is usually located interiorly of the large pocket so that it is not normally visible when the large pocket is exposed, wherein articles may be secreted from view in the interior pocket when the large pocket is exposed upon unfolding of the wallet construction.

1 Claim, 6 Drawing Figures

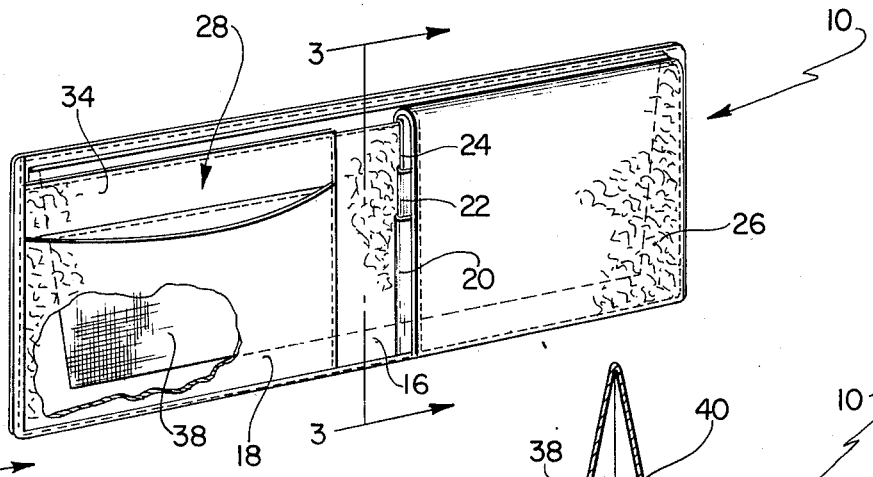
FIG. 1
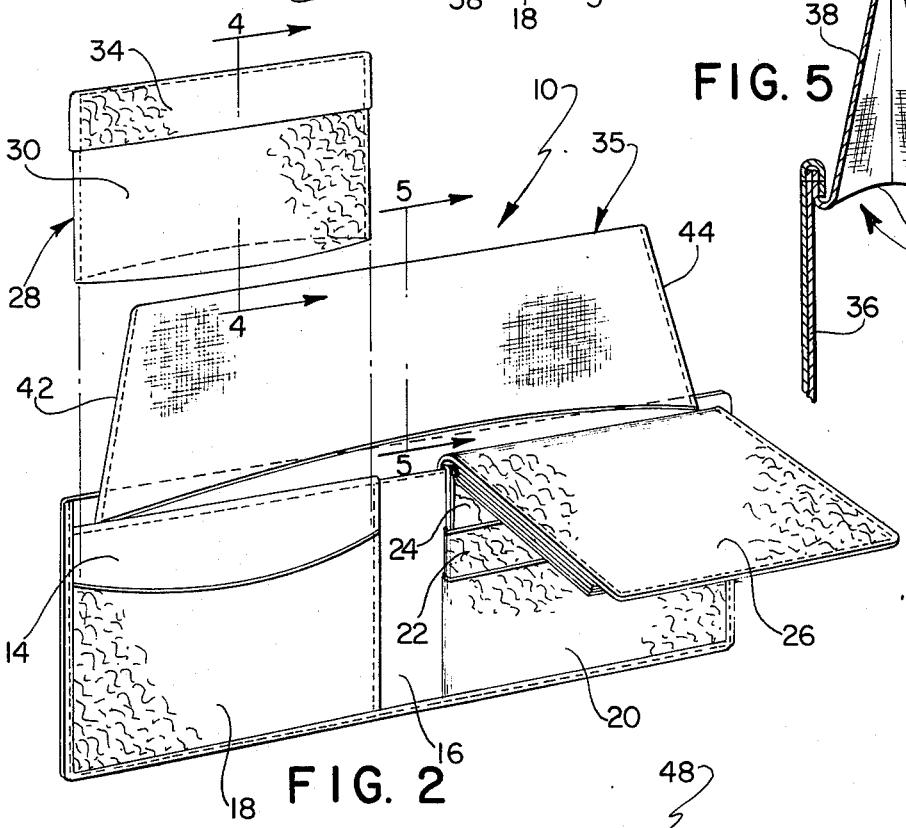
FIG. 2
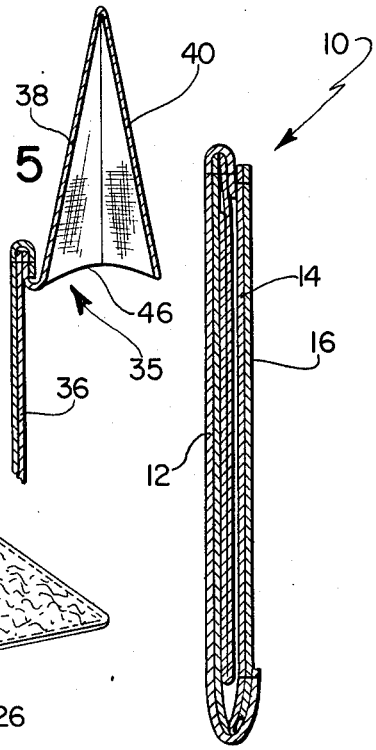
FIG. 5
FIG. 3
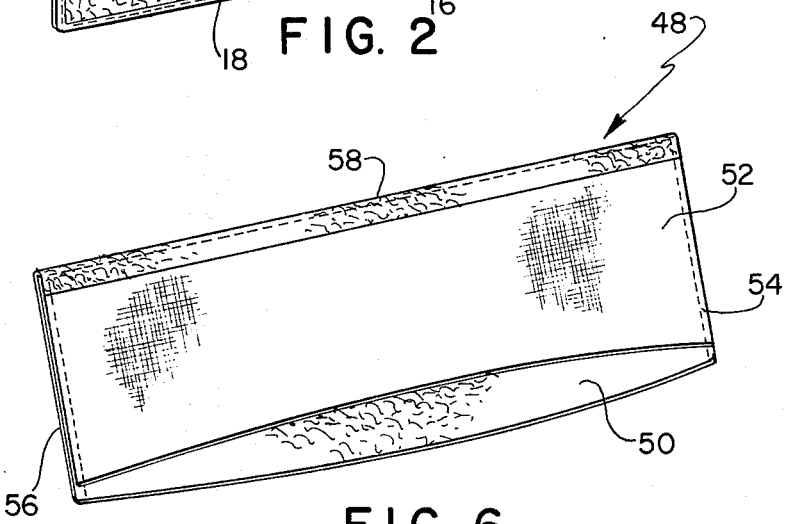
FIG. 6
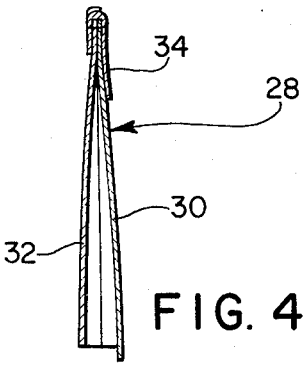
FIG. 4

WALLET CONSTRUCTION

BACKGROUND OF THE INVENTION

The present invention relates to a wallet construction and is of the type that includes an interior pocket for secreting valuable articles or currency therein so that they are not normally visible when the wallet construction is in an open and exposed positon.

Wallet constructions known heretofore have taken the usual form and have included a plurality of panels that define pockets therein for receiving various personal articles. Such wallets as known in the prior art constructions were satisfactory for the purposes intended and depending upon the manufacturer thereof included various shapes and configurations and locations of pockets therein.

Although the prior known wallet constructions normally included various arrangements of pockets for personal items, the combination of panels as defined in these articles were utilized in a conventional way and, in most instances, were not concerned with the concealment of valuables or currency therein. Some prior attempts have been made in the prior known wallet constructions to form a concealed pocket within the panels that define the wallet contructions, but such constructions were not entirely satisfactory and did not properly and completely define a sealed pocket when the wallet was in normal use.

SUMMARY OF THE INVENTION

The present invention defines an improvement over the prior known wallet constructions that included some form of an interiorly sealed pocket therein, and includes a rear panel and intermediate panel that is joined to the rear panel at the ends and along an interior longitudinal edge to define a large pocket therewith that extends the length of the panels and that is of a dimension for receiving paper currency therein. An interior pocket is located within the large pocket and occupies substantially the same dimension thereof, the interior pocket having a mouth that is normally located interiorly of said large pocket, so that it is not normally visible when the large pocket is exposed. Thus, articles of value and currency when located in the interior pocket are secreted from view when the large pocket is exposed upon the unfolding of the wallet construction for access to one or more of the pockets located therein.

Accordingly; it is an object of the present invention to provide a wallet construction that includes an interior pocket having a mouth that is normally located interiorly of the wallet construction so that articles of value deposited therein are not normally visible when the wallet construction is unfolded for access to the interior thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the invention:

FIG. 1 is a perspective view of the wallet construction embodied in the present invention as located in the open, unfolded position;

FIG. 2 is a view similar to FIG. 1 but showing the concealed pockets located in the wallet construction in an exploded or exterior position thereof;

FIG. 3 is a sectional view taken along line 3—3 in FIG. 1;

FIG. 4 is a sectional view taken along line 4—4 in FIG. 2;

FIG. 5 is a sectional view taken along line 5—5 in FIG. 2; and

FIG. 6 is a perspective view of a modified form of a concealed pocket as embodied in the present invention.

DESCRIPTION OF THE INVENTION

Referring now to the drawing and particularly to FIGS. 1 and 2, the wallet construction embodied in the present invention is illustrated and is generally indicated at 10. The panels of the wallet contruction 10 may be formed of any conventional material, such as leather or plastic; and the type of material from which these various panels are constructed forms no part of the present invention.

As shown in FIG. 3, the wallet construction 10 includes a rear panel 12 to which an intermediate panel 14 is joined along the side edges and bottom thereof. An intermediate overlay strip 16 is applied to the intermediate panel 14 at the fold portion thereof and reinforces the intermediate panel. Sewn or secured to the rear panel 12 and the intermediate panel 14 along the side and bottom edges thereof are a plurality of secondary panels. These panels are indicated in FIG. 2 as panels 18, 22 and 24. The panels 20, 22 and 24 are separated from panel 18 by the intermediate overlay panel 16 and are arranged in increasing, vertical dimension as seen in FIG. 2 so as to define open pockets for receiving various personal articles or cards therein. A flap 26 is also joined to the intermediate panel 14 and overlies the panels 20, 22 and 24 in the closed position thereof. A panel (not shown) is secured to the underside of the flap 26 and is normally formed with a window therein for receiving an identification card. A plastic insert having a plurality of leaves is also mounted in the pocket between panels 22 and 24 as is well known in the art. The panel 18 that overlies the intermediate panel 14 is foreshortened with respect thereto to define an open pocket for receiving an insert 28 therein. As shown in FIGS. 2 and 4, the insert 28 that is receivable in the pocket as defined by the panels 14 and 18 includes a front panel 30, a rear panel 32 and a strip 34 that is sewn to the uppermost edges of the panels 30 and 32 to define a closed end therewith. The insert 28 is insertable between the panels 14 and 18 with the open end thereof being directed to the bottom of the panels 14 and 18 as illustrated in FIG. 4. Thus, the insert 28 defines a concealed pocket when located in its position of use, and further forms a separator between the panels 14 and 18 for locating various articles therebetween and the panels 14 and 18.

One of the unique features of the wallet construction embodied herein is the provision of a secret pocket that is located between the rear panel 12 and intermediate panel 14 so that articles of value may be stored therein without exposing them when the wallet construction is opened for access to the various pockets as defined by the panels thereof. One form of such a secret pocket is generally indicated in FIGS. 2 and 5 at 35 and, as shown, includes a panel that is fixed to the rear panel 12 and is formed and folded in such a way as to define a lining for the rear panel 12 when in the position of use.

In this connection, the secret pocket 35 includes a panel 36 that is joined to the sides and bottom of the rear panel 12 and thus defines a lining therefor and is sewn to the top edge thereof as illustrated in FIG. 5. The upper edge of the panel 36 is not only sewn to the upper edge of the rear panel 12 but is also sewn to a first interior panel 38 that forms one side of the secret pocket 35. The panel 38 is folded at an outer end portion thereof and is integrally joined to a second interior panel 40 that cooperates with the panel 38 to define the interior or concealed pocket 35, as illustrated. The panels 38 and 40 are joined along the edges thereof as indicated at 42 and 44 in FIG. 2, the remaining end thereof being open to define a mouth 46 as indicated in FIG. 5. In order to conceal an article within the secret pocket as defined by the panels 38 and 40, the secret pocket is moved exteriorly of the large pocket located between the rear panel 12 and intermediate panel 14 to the position shown in FIGS. 2 and 5. Thereafter, an after the article for concealment is inserted therein, the concealed pocket 35 is then folded interiorly of the large pocket between the panels 12 and 14 to that position shown in FIGS. 1 and 3. In this position, the concealed pocket 35 defines a further liner for the rear panel 12 and cooperates with the intermediate panel 14 to define a pocket therebetween for receiving currency or the like that is normally exposed for access when the wallet construction is moved to an unfolded position.

As shown in FIG. 2, the insert 28 is entirely removable from its concealed position as contrasted with the secret pocket 35 as defined by the panels 38 and 40. However, a modified form of the invention shown in FIG. 6 does provide for removal of a large concealed pocket from the wallet constructions, and in this connection a large removable pocket generally indicated at 48 is provided. The removable pocket 48 is defined by a rear panel 50 to which is secured a front panel 52. The panels 50 and 52 are secured along side edges 54 and 56 and along a longitudinal edge 58 thereof to leave exposed an open mouth as indicated in FIG. 6. In this form, the removable pocket 48 closely resembles the insert 28 as previously described hereinabove. The removable pocket 48 is intended to be inserted into the wallet construction 10 in place of the secret pocket 35 as defined by the panels 36, 38 and 40. Thus, the removable pocket 48 is insertable between the rear panel 12 and intermediate panel 14 and defines a separator therebetween. Articles of value or currency may be placed in the pocket 48 between the panels 50 and 52 as inserted therein through the open mouth 50 and the pocket 48 is then placed between the rear panel 12, intermediate panel 14 with the open mouth 50 is located adjacent to the closed interior edge of the large pocket. The mouth of the pocket 48 is thus sealed from view when the wallet is unfolded to an open position. When it is necessary to remove the contents of the pocket 48, it is slid outwardly of the large pocket defined by the panels 12 and 14 to expose the interior of the pocket 48, wherein the articles may be removed therefrom.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A wallet construction, comprising a rear panel, an intermediate panel joined to said rear panel at the ends and along bottom edges thereof and defining a large pocket therewith that extends the length of said panel and that is of a dimension for receiving paper currency therein, an intermediate overlay strip overlapping said intermediate panel at a middle portion thereof for reinforcing said intermediate panel approximately along a fold line thereof, a plurality of secondary panels at least three marginal edges of which are joined to said intermediate panel to define a plurality of parallel extending, open-ended pockets, and an interior pocket located within said large pocket and having substantially the same longitudinal dimension thereof at least along an outer longitudinal edge threof, said interior pocket having a mouth that is normally located interiorly of said large pocket so that it is not normally visible when said large pocket is exposed, wherein articles of value or currency when located in said interior pocket are secreted from view when said large pocket is exposed upon the unfolding of said wallet construction for access to one or more of the pockets located therein, an interior pocket including a first interior panel that is joined to said rear panel at the outermost edge thereof for permanently attaching said interior pocket to said rear panel, and a second interior panel joined to said first interior panel along the sides thereof and along the edge normally located adjacent to a bottom edge of said rear panel, wherein the mouth of the interior pocket is exposed when the interior panels thereof are removed from said large pocket, and a removable insert normally located in one of said open-ended pockets and defining a separator therein, said removable insert having an open mouth for receiving an article of value therein and being normally disposed adjacent to the closed end of the open-ended pocket in which said removable insert is located and being located interiorly thereof.

* * * * *